US006150874A

United States Patent [19]

Fendt et al.

[11] Patent Number: 6,150,874

[45] **Date of Patent: *Nov. 21, 2000**

[54] CIRCUIT LAYOUT AND PROCESS FOR GENERATING A SUPPLY DC VOLTAGE

[75] Inventors: Günter Fendt; Norbert Müller, both of Schrobenhausen, Germany

[73] Assignee: Temic Telefunken microelectronic GmbH, Heilbronn, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/030,371

[22] Filed: Feb. 25, 1998

[30] Foreign Application Priority Data

Feb. 16, 1998 [DE] Germany ..... 197 07 422
Feb. 16, 1998 [DE] Germany ..... 197 07 423

[51] Int. Cl.[7] ..... G06G 7/12

[52] U.S. Cl. ..... 327/545; 327/314; 327/355

[58] Field of Search ..... 327/314, 320, 327/325, 326, 545, 355

[56] References Cited

U.S. PATENT DOCUMENTS

| | | | |
|---|---|---|---|
| 3,916,508 | 11/1975 | Conzelmann et al. | 29/574 |
| 5,150,188 | 9/1992 | Hara et al. | 357/41 |
| 5,347,170 | 9/1994 | Hayakawa et al. | 327/541 |
| 5,382,839 | 1/1995 | Shinohara | 327/545 |
| 5,504,452 | 4/1996 | Takenaka | 327/541 |
| 5,554,954 | 9/1996 | Takahashi | 327/546 |
| 5,786,721 | 7/1998 | Kim | 327/321 |
| 5,880,621 | 3/1999 | Ohashi | 327/534 |

FOREIGN PATENT DOCUMENTS

| | | |
|---|---|---|
| 0793159 | 9/1997 | European Pat. Off. . |
| 2533199 | 3/1978 | Germany . |
| 4113433 | 1/1992 | Germany . |
| 4131170 | 3/1993 | Germany . |

OTHER PUBLICATIONS

U. Tietze et al. : "Halbleiter–Schaltungstechnik [Semi–conductor Circuit Technology]", 10th edition, 1993, pp. 555–557.

Thomas, IBM Tech. Disc. Bult., "Non–Linear Diode Logical Circuits", Apr. 1996, pp. 27–30.

*Primary Examiner*—Terry D. Cunningham
*Attorney, Agent, or Firm*—Venable; Norman N. Kunitz

[57] ABSTRACT

The invention describes a circuit layout for generating a supply DC voltage in a dependent relationship to a non-constant input DC voltage in three voltage intervals, with the supply voltage being maintained at a constant nominal value in the intermediate voltage interval, and with the supply voltage being reduced by constant differential values in the other two voltage intervals in order to allow emergency functions to the maintained; implementation is effected by means of a diode arrangement for the first differential value, by means of a first Zener diode arrangement for maintaining the constant value, and by means of a second Zener diode arrangement for bridging the diode arrangement. In addition, a process will be described for generating an output voltage with superimposed current pulses for a signal generator unit which process will feed in such a supply voltage via a control circuit. The circuit layout according to this invention is particularly suitable for implementing this process.

7 Claims, 4 Drawing Sheets

1
2
SAT
S
K2
K1
RM1
RM2
T2
T3
TK
RK
Isat
Itest
Iconst
IR
Isignal
Uout
Uz
Ubatt
D1
D2
R1
R2
R3
Z1
Z2

[A]
.08
.06
.04
.02
0
$I_R$
$I_{signal}$
$U_{out}$ [V]
8.02
8.0
7.98
S [V]
4
2
0
200
[μA]
100
0
t [s]
400μ
600μ
800μ
.0010
.0012
.0014
.0016
.0018

CIRCUIT LAYOUT AND PROCESS FOR GENERATING A SUPPLY DC VOLTAGE

BACKGROUND OF THE INVENTION

This invention concerns a circuit layout or arrangement for generating a supply DC voltage at an output in a dependent relationship to an input DC voltage applied at the input end, wherein in a first voltage interval the input DC voltage, reduced by a constant first value, is provided, in a following second voltage interval the supply DC voltage is maintained at a constant level, and if the input DC voltage exceeds this second voltage interval, the supply DC voltage at the output end, reduced by a second constant value, follows or tracks the input DC voltage. The invention additionally relates to a process used to generate a supply DC voltage for a signal generator unit where the output voltage is derived from a non-constant input DC voltage and provided to the signal generator unit, preferably with a constant net value, and with the signal generator unit transmitting signals to an evaluation circuit by current pulses superimposed onto the output voltage.

Such circuit layouts are used to supply, e.g., sensors complete with a follow-on signal generator unit with a voltage designed such that variations in the input DC voltage do not constitute a risk or hazard for the functionality of the unit to be supplied. Here, it has proven to be advantageous to maintain the voltage difference—by which the supply voltage for the load lies under the input voltage, as shown in FIG. 1,—at a first constant value, up to a first input voltage value; and to maintain this voltage difference, from a certain input voltage value onwards, constant at a second greater value. In the transition range in between, when in normal mode, the supply voltage will remain constant and be independent of the input voltage.

Such a circuit layout is contained in DE 25 33 199 C3. This circuit layout will generate the described course of a supply voltage in a dependent relationship to the input voltage across a complex transistor circuit, the implementation of which is very laborious and involves very considerable costs.

In addition, DE 41 31 170 A describes a device in which a supply voltage is generated by means of a Zener diode (Z-diode) and a comparator, as well as a controllable current source, which supply voltage will change at intervals in a dependent relationship to the input voltage applied. This layout also proves to be too laborious and costly due to its complexity, in particular the requirement for a controllable current source.

Furthermore, the state of the art knows and comprises additional circuit layouts for voltage stabilization by means of a Z-diode (compare Tietze/Schenk: Halbleiterschaltungstechnik (Semiconductor Circuit Technology), 10th edition 1993, page 555 ff.).

The above-mentioned state of the art also comprises processes for generating such a supply DC voltage.

Here, the supply voltage is gained from a non-constant input DC voltage—such as from a battery, for example,—and provided to the signal generator unit. The signal transmission from the signal generator unit to an evaluation circuit is effected by means of current pulses superimposed upon the supply voltage; the supply DC voltage required for the signal generator unit will preferably be maintained at a constant nominal value which ensures safe signal transmission and signal recognition, and which is also required for circuit elements—sensors, for example,—post-connected to the signal generator unit.

A preferred area of application for such processes is the coupling of decentralized sensor systems with a central electronic control system in motor vehicles whereby the externalized sensors and associated signal generator units will no longer be supplied direct from the onboard power supply but indirectly from the central control unit by means of a current interface. Here, the current variations along the energy supply line to the externalized signal generator unit will be evaluated by a central control unit. Due to the ohmic and capacitive constituents of the sensor and signal generator unit, as well as the electric lines, any voltage change in the central control unit will result in a current change interfering with the superimposed current pulses. Thus, signal evaluation is particularly prone to interference from supply voltage variations.

SUMMARY OF THE INVENTION

The object of the invention is to provide a circuit layout for generating a supply DC voltage, by means of which the above-described course of the supply DC voltage in a dependent relationship to the input DC voltage can be easily and simply achieved. Furthermore, it is another task of this invention to provide a process used to generate a supply DC voltage for a signal generator unit, in which process any variations in the input DC voltage largely do not interfere with the transmission of the current signal.

The above object generally is achieved according to apparatus of the present invention by a circuit arrangement or layout for generating a supply DC voltage at an output in a dependent relationship to a non-constant input DC voltage applied at the input end, where in a first voltage interval the input DC voltage, reduced by a constant first value ($\Delta U_1$) is provided, where in a following second voltage interval the supply DC voltage is maintained at a constant level, and where, if the input DC voltage ($U_{Batt}$) exceeds this second voltage interval ($I_2$), the supply DC voltage ($U_Z$) at the output end, reduced by a second constant value ($\Delta U_2$), following the input DC voltage ($U_{Batt}$), with the DC supply circuit having: starting from the input DC voltage in a first current path, a number (n) of serially connected diodes ($D_1 \ldots D_n$) whose connections are made in pass direction, which, on the one hand, are connected to ground via a first resistor, and which, on the other hand, are connected to the output of the supply DC voltage ($U_Z$) via a second high impedance resistor; in parallel to the first current path, a second current path that is connected from the input DC voltage ($U_{Batt}$), via a first Zener diode arrangement, to the output of the supply; and a connection between the output of the supply DC voltage supply and ground via a third resistor and, in a series connection, a second Zener diode arrangement.

The above object is achieved according to the process aspect of the invention by a process for generating an output voltage for a signal generator unit where the output voltage is derived from a non-constant input DC voltage and provided to the signal generator unit, preferably with a constant net value with the signal generator unit transmitting signals to an evaluation circuit by current pulses superimposed onto the voltage ($U_{out}$) with the process comprising connecting the signal generator across the non-constant DC voltage source; generating a supply DC voltage in a dependent relationship to the input DC voltage in preferably three interrelated input voltage intervals ($I_1$, $I_2$, $I_3$) such that the input voltage reduced by a constant first value is provided in a first voltage interval, the supply DC voltage is provided as a constant nominal value in a following second voltage interval, and the supply DC voltage—reduced by a second constant value—tracks the input voltage, if the input voltage exceeds this second voltage interval; and causing the output voltage at the output to the signal generator unit to track the generated supply DC voltage.

The circuit layout generates the required course of the supply DC voltage in a dependent relationship to the input DC voltage by means of a surprisingly simple circuit layout based on two Z-diode arrangements. Advantageous further applications of the invention are described. In particular, these describe how to dimension the various individual components. Control circuit tracking allows a current decoupling of the circuit layout without feedback.

This circuit layout is particularly advantageous for a process used to generate a supply DC voltage for a signal generator unit, with it being possible in principle to use other circuit layouts in this process, having the same effect in accordance with the preamble. In a dependent relationship to the input DC voltage, a supply DC voltage will be provided in several intervals, which will cause, without feedback, and via a control circuit, the supply DC voltage at the connection to the signal generator unit to track the generated supply DC voltage. Preferably; three interrelated input voltage intervals are differentiated here. In a first voltage interval, the supply DC voltage will track the input DC voltage but be reduced by a constant first value, which ensures emergency operation of the signal generator unit; and which also enables the evaluation circuit to evaluate the signals of the signal generator unit, even though these are reduced. In a following second voltage interval, the supply DC voltage will be maintained at a constant nominal value. That is, there will be a voltage compensation for standard operating mode conditions. However, if the input DC voltage exceeds this second voltage interval, the supply DC voltage will track the input DC voltage but be reduced by a second constant input DC voltage value. The solution according to this invention also ensures support for states on the signal generator unit that are defined outside the compensated voltage range applied in normal operating conditions and thus provides for the best possible maintenance of the operation of signal generator unit and evaluation circuit, for example in the event of input voltage variations. This process, which is so advantageous for signal transmission by means of the signal current, can be implemented most simply and effectively by the circuit layout in accordance with the circuit according to the invention. However, in principle, other circuit layouts such as those provided by the patent application DE 196 07 802 (EP 0 793 159), not yet disclosed, may also be used here for generating the three voltage intervals. For this process, these circuit layouts will then need to be integrated properly into the control circuit in accordance with the process according to the invention so that the control circuit will cause the output voltage on the connection to the signal generator unit (Sat) to track the supply DC voltage generated and which control circuit will ensure that there is no feedback.

BRIEF DESCRIPTION OF THE DRAWINGS

Below, this invention will be further elucidated by means of embodiment examples and figures, wherein.

DETAILED DESCRIPTION OF THE PREFERRED EMBODIMENTS

Figure 1:
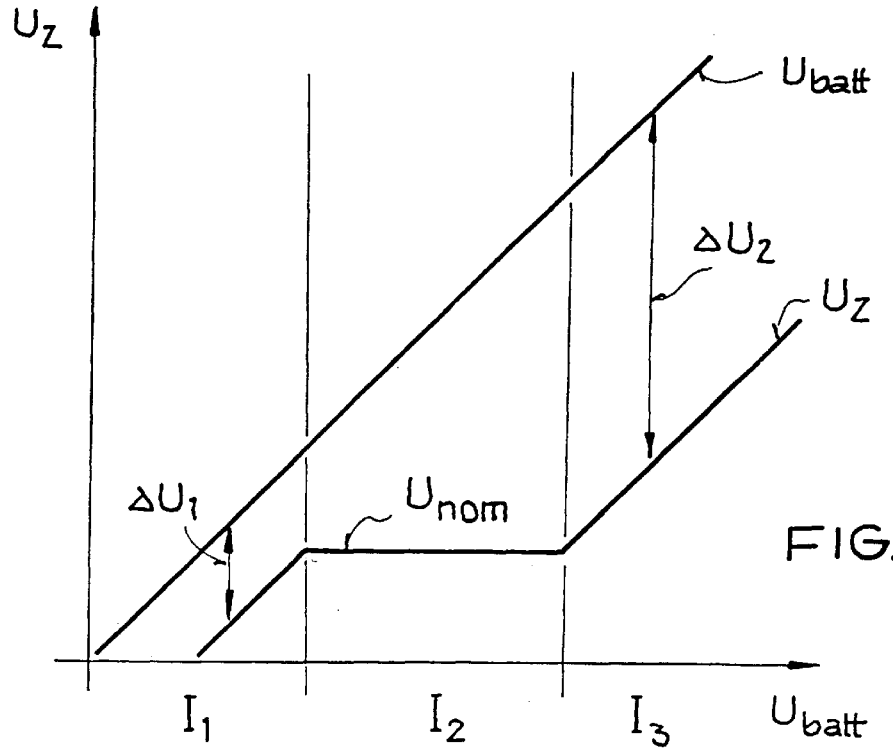
FIG. 1 shows the supply voltage in a dependent relationship to the applied input DC voltage.

FIG. 1 shows the three voltage intervals $I_1$, $I_2$, $I_3$ of the input DC voltage $U_{Batt}$ as well as the allocated supply voltage $U_{out}$ at the output end. As can be seen from the first interval $I_1$, in this range the supply DC voltage $U_Z$ will track the input DC voltage $U_{Batt}$ but be reduced by a constant first value $\Delta U_1$. In the interval $I_2$, which represents the standard mode of operation, the supply voltage $U_{out}$ will be maintained at the required nominal voltage $U_{nom}$. However, if the input voltage $U_{Batt}$ exceeds this second voltage interval $I_2$, an output voltage $U_{out}$ will be generated in voltage interval $I_3$, which will track the input voltage $U_{Batt}$ but be reduced by a second constant value $\Delta U_2$. The technical circuit implementation options will be explained further in connection with FIGS. 3 and 5.

Figure 2:
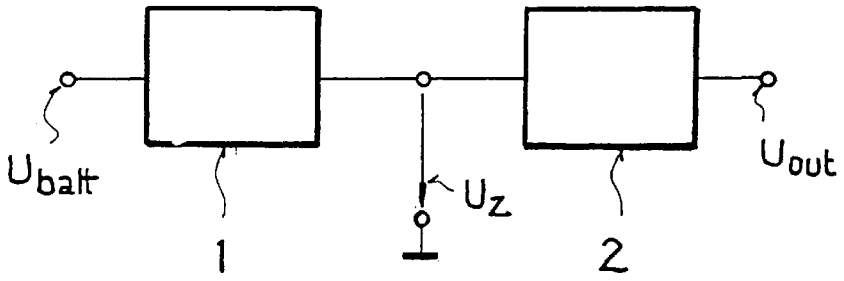
FIG. 2 is a block diagram of the process.

FIG. 2 now shows a block diagram of the process. The input DC voltage $U_{Batt}$ may vary beyond the limits of interval $I_1$—for instance in the case of a battery, due to temperature influence or other load elements. As graphically illustrated in FIG. 1, the circuit layout 1 or arrangement will generate initially the supply DC voltage $U_Z$ from the input DC voltage, whilst control circuit 2 will cause the output voltage $U_{out}$ at the connection of the unit to be supplied (for example, a signal generator unit (Sat), compare with example embodiment as per FIG. 3) to track the supply DC voltage $U_Z$ generated by circuit layout 1.

Figure 3:
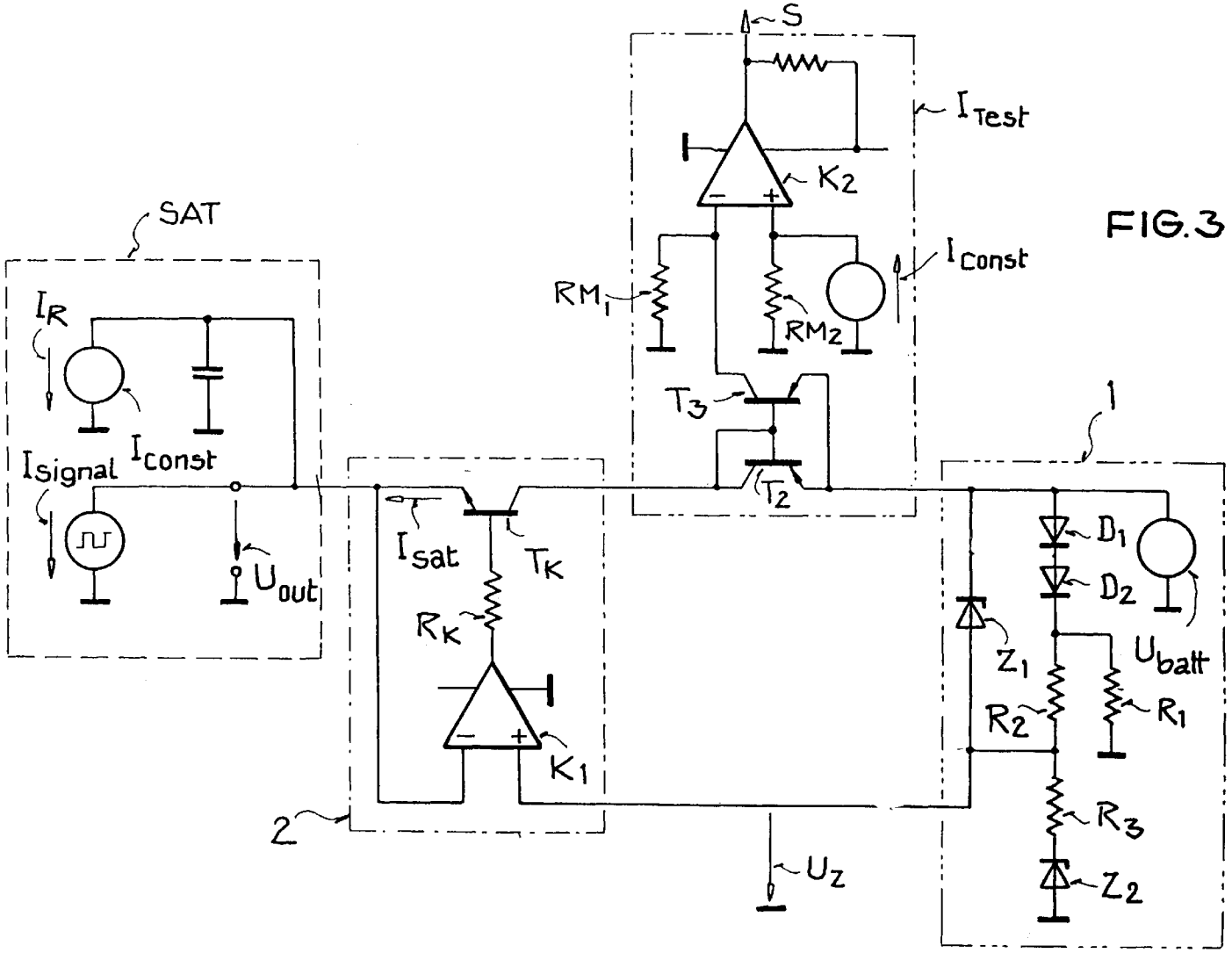
FIG. 3 is a block diagram showing the entire layout comprised of the circuit layout for generating the supply DC voltage, control circuit, signal generator unit, and allocated evaluation circuit.

The current pulses $I_{signal}$ generated by the signal generator unit Sat, as shown in the embodiment example described in more detail in FIG. 3, do not cause variations in the applied output voltage $U_{out}$ as the control circuit 2 connected in between will compensate these immediately without any feedback to circuit layout 1.

FIG. 3 shows a block diagram with the entire layout comprised of the:

circuit layout for generating the supply DC voltage 1, control circuit 2, signal generator unit Sat, and allocated evaluation circuit ($I_{test}$).

As the circuit layout for generating the supply DC voltage 1 will be illustrated again in detail in FIG. 5, this part will be described for both figures together.

Figure 5:
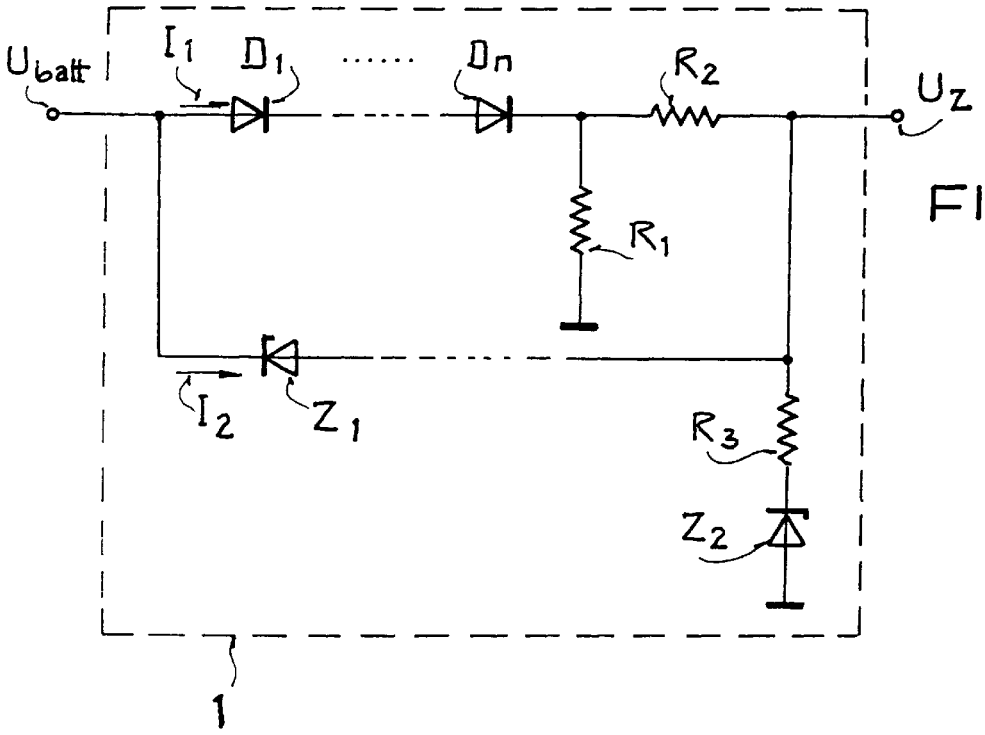
FIG. 5 is a detail of the circuit layout for generating the supply DC voltage from the input DC voltage.

FIGS. 3 and 5 show the input complete with the non-compensated, non-constant input DC voltage $U_{Batt}$, a vehicle battery connection for example. Starting from the input DC voltage $U_{Batt}$, there is a first current path $I_1$, as well as a second current path $I_2$ which is located in parallel with the first path. In $I_1$ there are arranged a number n of serially connected diodes $D_1 \ldots D_n$ such that their terminal connections are made in the pass direction, with the number n of the diodes D determining the first constant value $\Delta U_1$.

In order to ensure a voltage drop across the diodes $D_1 \ldots D_n$, these are connected via a first resistor $R_1$ to ground; thus, a diode current is produced which is sufficiently high so that the diodes $D_1 \ldots D_n$ are driven into the pass range. On the other hand, the last diode ($D_2$ in FIG. 3, $D_n$ in FIG. 5) is connected to the output of the supply for DC voltage $U_Z$ via a second high-ohmic resistor $R_2$. In parallel to the layout in the first current path $I_1$, there is a current path $I_2$ which, starting from the input DC voltage $U_{Batt}$, features a Z diode $Z_1$ connected to output $U_Z$. In addition, the output of the supply DC voltage $U_Z$ is connected to ground, via a third resistor $R_3$ and, in series-connection, via a second Z-diode arrangement $Z_2$.

In terms of the technical circuit layout, the course of the supply DC voltage $U_Z$ already shown in FIG. 1 will be as follows:

In the first voltage interval $I_1$ of the input DC voltage $U_{Batt}$, the input DC voltage $U_{Batt}$ will be tracked constantly by the supply DC voltage $U_Z$ which is reduced by the voltage drop $U_D$ across the diodes $D_1 \ldots D_n$ until the Zener voltage of $Z_2$ has been reached. If the input DC voltage $U_{Batt}$ now exceeds the value of $Z_2$, the second Zener diode $Z_2$ becomes conductive. The current through the diodes $D_1 \ldots D_n$ thus can flow to ground across resistor $R_1$ as well as—in parallel to this resistor $R_1$—through the series arrangement of $R_2$, $R_3$, and $Z_2$. This produces a voltage divider consisting of the resistors $R_2$ and $R_3$, with $R_2$—in relation to $R_3$—to have a higher impedance value by a factor of 100 so that a voltage change in the input DC voltage $U_{Batt}$ will have an effect on $D_1 \ldots D_n$ which is reduced by a factor of 100 and thus not recognizable. A compensation of the input DC voltage changes or the battery voltage variations is achieved. However, if the input DC voltage $U_{Batt}$ exceeds a value which is approximately $UZ_2$ plus $UZ_1$, the first Zener diode $Z_1$ in the second current path $I_2$ will also become conductive. In this way, the diodes as well as resistor $R_2$ will be bridged. The voltage divider between $R_2$ and $R_3$ no longer operates. The supply DC voltage $U_Z$ now tracks—in the form of a second constant value $\Delta U_2$—the input DC voltage $U_{batt}$, with the second value $\Delta U_2$ being largely determined by the voltage $UZ_1$. Here, the Zener diode arrangements $Z_1$ and $Z_2$can be implemented in the form of simple Z diodes as well as in the form of temperature-compensated Zener diode arrangements, for example by means of series a connection with temperature-compensating diodes featuring an appropriate different temperature coefficient. This will produce the required dependent relationship of the supply DC voltage $U_Z$ from the applied input DC voltage $U_{Batt}$. Naturally, due to its simplicity, this embodiment of the circuit layout according to FIG. 5 can also be used advantageously for other applications than shown in FIG. 3, that is, without a signal generator unit for current signaling and th e associated evaluation circuit or control circuit 2.

If, starting from the circuit layout 1 discussed here, we now consider the entire arrangement according to FIG. 3, this shows the preferred use of the circuit layout for supplying voltage to a signal generator unit Sat, with this unit being driven by a control circuit 2. Instead of the particularly preferred embodiment of the circuit layout 1 according to FIG. 5, it is also possible in principle to arrange another suitable circuit layout—such as the layout described in DE 196 07 802 (EP 0 793 159)—to be located ahead of control circuit 2, with the embodiment of circuit layout 1 according to FIG. 5 featuring the advantages already described above.

Irrespective of the embodiment of the circuit layout 1, the control circuit 2 balances the output voltage $U_{out}$ with the supply DC voltage $U_Z$ applied at its input. On the one hand, the signal generator unit Sat features a quiescent current path $I_R$, and, on the other hand, it has a signal current path $I_{signal}$. As is known, this can be achieved, for example, by means of switchable signal loads. At the input end, the evaluation circuit $I_{test}$ is located between the control circuit 2 and the non-compensated input of circuit layout 1, at which $U_{Batt}$ is applied; this evaluation circuit $I_{test}$—by means of a current mirror made up of the transistors $T_2$and $T_3$, as well as the resistors $RM_1$ and $RM_2$, and a constant current source—evaluates the signal current $I_{signal}$ transmitted by the signal generator unit Sat such that a comparator $K_2$ compares the voltage drops across the resistors $RM_1$ and $RM_2$ and feeds the output signal S to a microprocessor, for example, where it is to be further processed. The control circuit 2 is made up of a comparator $K_1$ at the output of which the resistor $R_K$ and the transistor $T_K$ are located, with the transistor $T_K$ being connected, as a series transistor, with its base to comparator $K_1$ and with its emitter to the signal generator unit Sat. In the comparator $K_1$, the supply DC voltage $U_Z$ generated by the circuit layout 1 will be compared to $U_{out}$, and $U_{out}$ control will be adjusted correspondingly.

In this embodiment example, the significant current signals $I_{signal}$ for signal transmission—with a value of 40 mA—factually do not act on the supply voltage generating circuit layout 1, decoupled—as they are—from control circuit 2. Uninfluenced as it were, the current signals $I_{signal}$ will be fed through transistor TK to the current-measuring evaluation circuit $I_{test}$ where they are recognized. The voltage across the evaluation circuit $I_{test}$ results thus as the differential value between the input DC voltage $U_{Batt}$ and the output voltage $U_{out}$ on the signal generator unit Sat as well as the voltage drop across transistor TK. The difference will be limited by the process used, and thus will be approximately between the values $\Delta U_1$ and $\Delta U_2$. The functionality of the evaluation circuit $I_{test}$ is thus ensured by means of circuit layout 1 and control circuit 2, even though the input DC voltage $U_{Batt}$ strongly deviates from the required nominal voltage $U_{nom}$.

Figures 4A, 4B, 4C, 4D:
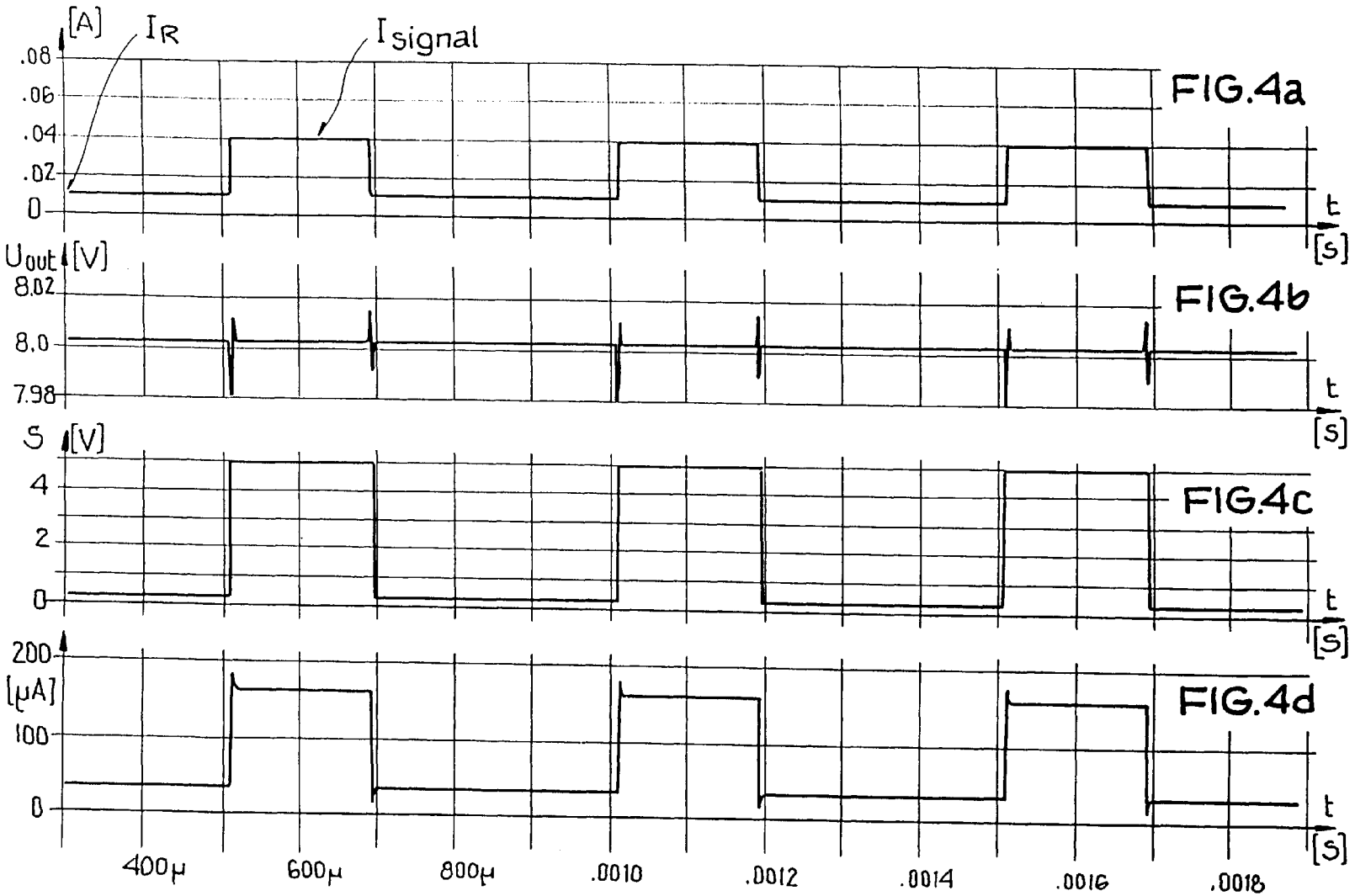
FIG. 4*a* shows the current pulses of the signal generator unit.
FIG. 4*b* shows the voltage on the signal generator unit.
FIG. 4*c* shows the output level of the evaluation circuit.
FIG. 4*d* shows the base current of the series transistor in the control circuit.

FIG. 4 illustrates the function courses for characteristic quantities in the circuit layout shown in FIG. 3. Thus, FIG. 4*a* shows the current pulses $I_{signal}$ plus the constant quiescent current $I_r$. Diagram 4*b* shows the output voltage $U_{out}$ on the signal generator unit Sat. The output voltage $U_{out}$ features extremely short deflections in the edge moments of signal current $I_{signal}$ but will be immediately returned by control circuit 2 to its preset operating point; this is done by the base current in control circuit 2 being triggered (compare FIG. 4*d*). On the output S of the evaluation circuit $I_{test}$, the signal arrives in an unadultered form (compare FIG. 4*c*).

What is claimed is:

1. Circuit layout for generating a supply DC voltage ($U_Z$) at an output in a dependent relationship to a non-constant input DC voltage ($U_{Batt}$) applied at the input end, i1) where in a first voltage interval ($I_1$) the input DC voltage ($U_{Batt}$), reduced by a constant first value ($\Delta U_1$), is transmitted, and i2) where in a following second voltage interval ($I_2$) the supply DC voltage ($U_Z$) will be maintained at a constant level ($U_{nenn}$), and i3) where, if the input DC voltage ($U_{Batt}$) exceeds this second voltage interval ($I_2$), the supply DC voltage ($U_Z$) at the output end, reduced by a second constant value ($\Delta U_2$), follows the input DC voltage ($U_{Batt}$), wherein (a) starting from the input DC voltage ($U_{Batt}$), in a first current path, there are a number (n) of serially connected diodes ($D_1 \ldots D_n$) whose connections are made in pass direction, which, on the one hand, are connected to ground via a first resistor ($R_1$), and which, on the other hand, are connected to the output of the supply DC voltage ($U_Z$) via a second high impedance resistor ($R_2$).

(b) there is, in parallel to the first current path, a second current path which is connected from the input DC voltage ($U_{Batt}$), via a first Zener diode arrangement ($Z_1$), to the output, and (c) the output of the supply DC voltage ($U_Z$) is connected to ground via a third resistor ($R_3$) and, in a series connection, via a second Zener diode arrangement ($Z_2$).

2. Circuit layout according to claim 1 wherein the first value ($\Delta U_1$) of the reduction of the output voltage in relation to the input DC voltage ($U_{Batt}$) is determined by the number of diodes as well as the Zener voltages in the first and second Zener diode arrangements ($Z_1$, $Z_2$).

3. Circuit layout according to claim 1 wherein the Zener voltage of the second Zener diode arrangement ($Z_2$) will determine the delimitation between the first and second voltage intervals ($I_1/I_2$).

4. Circuit layout according to claim 1 wherein a control circuit means (2) is connected between the output of the circuit layout (1) and a unit (Sat) such that an output voltage ($U_{out}$) generated by the control circuit (2) which is supplied to the unit (Sat), tracks the supply voltage ($U_Z$).

5. Process for generating an output voltage ($U_{out}$) at an output of a signal generator unit (Sat) that, via said output, transmits signals to an evaluation circuit ($I_{test}$) by current pulses ($I_{signal}$) superimposed onto the output voltage ($U_{out}$), and where the output voltage ($U_{out}$) is derived from a non-constant input DC voltage ($U_{batt}$) and provided to the output of the signal generator unit (Sat), preferably with a constant net value ($U_{nom}$), said process comprising:

connecting the output of the signal generator (Sat) to a non-constant input DC voltage source via a voltage regulator;

generating a DC voltage ($U_Z$) in a dependent relationship to the input DC voltage ($U_{batt}$) in preferably three interrelated input voltage intervals ($I_1$, $I_2$, $I_3$) such that i1) the input DC voltage ($U_{batt}$) is provided in a first voltage interval ($I_1$), reduced by a constant first value ($\Delta U_1$), i2) in a following second voltage interval ($I_2$), the DC voltage ($U_Z$) is provided as a constant nominal value ($U_{nom}$), and i3) if the input voltage ($U_{batt}$) exceeds this second voltage interval ($I_2$), the DC voltage ($U_Z$), reduced by a second constant value ($\Delta U_2$), tracks the input voltage, and controlling the output voltage $U_{out}$ at the output to the signal generator unit (Sat) via the regulator so as to track the generated DC voltage ($U_Z$).

6. Process for generating an output voltage ($U_{out}$) for a signal generator unit (Sat) where the output voltage ($U_{out}$) is derived from a non-constant input DC voltage ($U_{batt}$) and provided to the signal generator unit (Sat), preferably with a constant net value ($U_{nenn}$), and with the signal generator unit (Sat) transmitting signals to an evaluation circuit ($I_{mess}$) by current pulses ($I_{signal}$) superimposed onto the output voltage ($U_{out}$), said process comprising:

generating a DC voltage ($U_Z$) in a dependent relationship to the input DC voltage ($U_{batt}$) in preferably three interrelated input voltage intervals ($I_a$, $I_2$, $I_3$) such that i1) the input DC voltage ($U_{batt}$) is provided in a first voltage interval ($I_1$), reduced by a constant first value ($\Delta U_1$), i2) in a following second voltage interval ($I_2$), the DC voltage ($U_Z$) is provided as a constant nominal value ($U_{nom}$), and i3) if the input voltage ($U_{batt}$) exceeds this second voltage interval ($I_2$), the DC voltage ($U_Z$), reduced by a second constant value ($\Delta U_2$), tracks the input voltage;

controlling the output voltage $U_{out}$ at the output of the signal generator unit (Sat) to track the generated DC voltage ($U_Z$); and wherein said step of generating the DC voltage ($U_Z$) includes connecting a circuit arrangement to the non-constant voltage source ($U_{batt}$) to provide the D.C. voltage ($U_Z$) at its output, with the circuit arrangement comprising:

a first current path, having a number (n) of serially connected diodes ($D_1 \ldots D_n$) whose connections are in a pass direction, connected at one end to the input DC voltage ($U_{batt}$) and at its other end to ground via a first resistor ($R_1$) and to the output for the DC voltage ($U_Z$) via a second high impedance resistor ($R_2$); a second current path, connected in parallel to the first current path, and comprising a first Zener diode arrangement ($Z_1$) connecting the input DC voltage ($U_{batt}$) to the output for the DC voltage ($V_2$), and, a third resistor ($R_3$), in a series connection with a second Zener diode arrangement ($Z_2$), connecting the output for the DC voltage ($U_Z$) to ground.

7. Process for generating an output voltage ($U_{out}$) at a port of a signal generator unit (Sat), where the output voltage is derived from a non-constant DC input voltage source ($U_{Batt}$) and provided to the signal generator unit (Sat), preferably with a constant net value, that transmits signals to an evaluation circuit via the same port by current pulses ($I_{Signal}$), and said process compromising:

generating a reference DC voltage ($U_Z$) in a dependent relationship to the input DC voltage ($U_{Batt}$) in three preferably interrelated input voltage intervals ($I_1$, $I_2$, $I_3$) such that i1) in a first voltage interval ($I_1$) the reference voltage ($U_Z$) is (equal) the input DC voltage ($U_{Batt}$) reduced by a constant first value, i2) in a following second voltage interval ($I_2$), the reference voltage is provided at a constant nominal value, and i3) in the third voltage interval, when the input voltage ($U_{Batt}$) exceeds this second voltage interval ($I_2$), the reference voltage tracks the input voltage reduced by a second constant value, and providing the output voltage ($U_{out}$) to the port of the signal generator unit (Sat) via a control circuit, which is responsive to the reference voltage ($U_2$, which is connected between the port and the DC input voltage source ($U_{Batt}$), and which regulates the output voltage ($U_{out}$) at the port so as to track the generated reference voltage ($U_Z$) independently from the current pulses ($I_{signal}$).

* * * * *

UNITED STATES PATENT AND TRADEMARK OFFICE

CERTIFICATE OF CORRECTION

PATENT NO. : 6,150,874
DATED : November 21, 2000
INVENTOR(S) : Günter Fendt et al.

It is certified that error appears in the above-identified patent and that said Letters Patent is hereby corrected as shown below:

Title page,
Change line [30] to read -- February 25, 1997 [DE] Germany ...
197 07 422 and February 25, 1997 [DE] Germany ..... 197 07 423 --

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*